United States Patent [19]

Keem et al.

[11] 4,120,615

[45] Oct. 17, 1978

[54] BOX FANS

[75] Inventors: Phillip William Keem, North Croydon; Laimons Kaimins, Forest Hill; James Graham, Eltham, all of Australia

[73] Assignee: Allware Agencies Limited, London, England

[21] Appl. No.: 765,628

[22] Filed: Feb. 4, 1977

[51] Int. Cl.[2] ..... F04B 39/02

[52] U.S. Cl. ..... 417/360; 417/423 R; 417/234; 415/121 G; 415/DIG. 5; 220/69; 220/306; 220/324

[58] Field of Search ..... 417/234, 360, 361, 423; 415/121 G, DIG. 5; 220/69, 306, 324

[56] References Cited

U.S. PATENT DOCUMENTS

| | | | |
|---|---|---|---|
| 1,637,553 | 8/1927 | Coleman | 220/69 |
| 2,394,319 | 2/1946 | McDonald | 220/69 |
| 2,950,859 | 8/1960 | Kirk | 417/234 |
| 2,961,152 | 11/1960 | Douglas et al. | 417/360 |
| 3,208,620 | 9/1965 | Herdering | 220/306 |
| 3,348,668 | 10/1967 | Amatsu et al. | 220/324 |
| 3,390,806 | 7/1968 | Herbert | 220/324 |

FOREIGN PATENT DOCUMENTS

| | | | |
|---|---|---|---|
| 459,701 | 4/1971 | Australia | 417/234 |
| 252,791 | 3/1967 | Austria | 220/306 |
| 796,580 | 10/1968 | Canada | 220/306 |

*Primary Examiner*—C. J. Husar

*Attorney, Agent, or Firm*—Fitch, Even, Tabin & Luedeka

[57] ABSTRACT

A box fan comprising a box-like structure containing an electric motor and a fan blade assembly operable by the motor, which structure consists of a front section and a rear section forming a box having front and rear openings which are interconnected to form a duct through said box, the fan blade assembly being positioned for causing air flow through the duct when the motor is operating, wherein the two sections are held securely together by a locking means including external resiliently operable disguised clamps which are disposed transversely of the interface between said sections.

9 Claims, 4 Drawing Figures

BOX FANS

BACKGROUND OF THE INVENTION (i) Field of the Invention

The present invention relates to fans of a type known as box fans.

(ii) Description of the Prior Art

Fans in which the fan-blade assembly is exposed are potentially dangerous, particularly to children, consequently the enclosure of the fan blade assembly affords obvious advantages. Fan-blade assemblies have been enclosed within cage-like structures and box-like structures. The latter type usually consist of a box containing two openings in opposing faces which are joined to form a duct containing the motor and the fan-blade assembly. Both openings are normally enclosed by a grille. A particular type of box fan is disclosed in Australian Pat. No. 459,701, in which the fan blade assembly is partially located within a dished rear grille and the front grille is rotated by means of a slipping clutch cooperating with an output shaft connected to the motor through reduction gearing.

The parts comprising the box which contains the fan are, in the preferred embodiment described in specification No. 459,701, assembled by the use of screws, the heads of which are visible from the exterior of the fan. It is readily discernible how such a fan can be disassembled and it is therefore relatively easy for persons to expose themselves to possibly dangerous electrical voltages on electrical components of the fan. This is, of course, undesirable of itself and, furthermore, may lead to safety authorities requiring that the electrical motor be earthed thus necessitating the use of a three-core electrical flex for coupling the fan to an electricity supply, whereas a two-core flex may otherwise be permissible with consequent cost savings in manufacture. Again, additional cost savings may also accrue by virtue of the replacement of screws with less labour intensive means.

BRIEF SUMMARY OF THE INVENTION

Accordingly, the present invention provides a box fan comprising a box-like structure containing an electric motor and a fan blade assembly operable by the motor, which structure consists of a front section and a rear section forming a box having front and rear openings which are interconnected to form a duct through said box, the fan blade assembly being positioned for causing air flow through the duct when the motor is operating, wherein the two sections are held securely together by a locking means including external resiliently operable disguised clamps which are disposed transversely of the interface between said sections.

Reference throughout this specification to the relative terms front and rear, refers to the direction of air flow when the fan is in use.

Preferably said locking means further includes an interlocking means, elements of which are disposed at adjacent interfacial edges of the sections and which means is releasable by pivoting the two sections about the adjacent interfacial edges as an axis, said clamps being positioned at a side of the box opposite to that of the interlocking means, thereby preventing said pivoting to disengage the cooperating elements.

Preferably, too, the disguised clamps are so configured as to appear to form a primary function other than that of a clamp. For example, such clamps may take the form of feet, a carrying handle, an escutcheon incorporating a sliding switch, or a combination of several such features. Preferably also the rear grille is dished so that the fan blade assembly can be partially located within the rear grille. The front grille may consist of air directing louvres which are disposed at different angles to the direction of air flow. The front grille may also be connected to the output shaft by means of a slipping clutch mechanism, while the output shaft is in turn connected to the motor through reduction gearing such that when the fan is in use the front grille slowly rotates.

Preferably, electrical control equipment for the fan is housed in said box. The motor may be supported coaxially within the duct such as by vanes extending inwardly from the periphery of the duct. These vanes may be integrally moulded with one of said sections of said structure. Elements of the interlocking means may also be integrally moulded with the said sections. Said control equipment may be connected to the motor by means of insulated conductors extending therebetween and along or within one of the said vanes and through the wall of said duct into the interior of said box. Further insulated conductors may extend through the wall of said box and from the control equipment exteriorally of the box for connecting the fan to a source of electricity.

Preferably, each said clamp is resilient and has a base portion which underlies the said box and upstanding end portions with inwardly projecting hook portions at free ends of said end portion, said sections having ramp elements disposed to engage the hook members and, by camming action, outwardly deform these against the resilience of the clip, when the clamp is pressed towards the juxtaposed structure sections to allow the hook portions to pass over inwardly projecting ends of the elements whereupon the end portions resiliently deform inwardly to locate said hook portions over the elements whereby the clamp holds the sections together. Preferably the clamps are provided with openings extending upwardly from a surface of said base portion opposite the side of the base portion from which said end portions project to enable each end portion to be levered outwardly, by insertion of a rod in a said opening to clear the corresponding hook portion from engagement over its cooperating ramp element thereby to permit removal of the clamp and disassembly of said structure.

The invention is further described with reference to the accompanying drawings.

BRIEF SUMMARY OF THE VIEWS DEPICTED BY THE DRAWINGS

DETAILED DESCRIPTION

Figure 1:
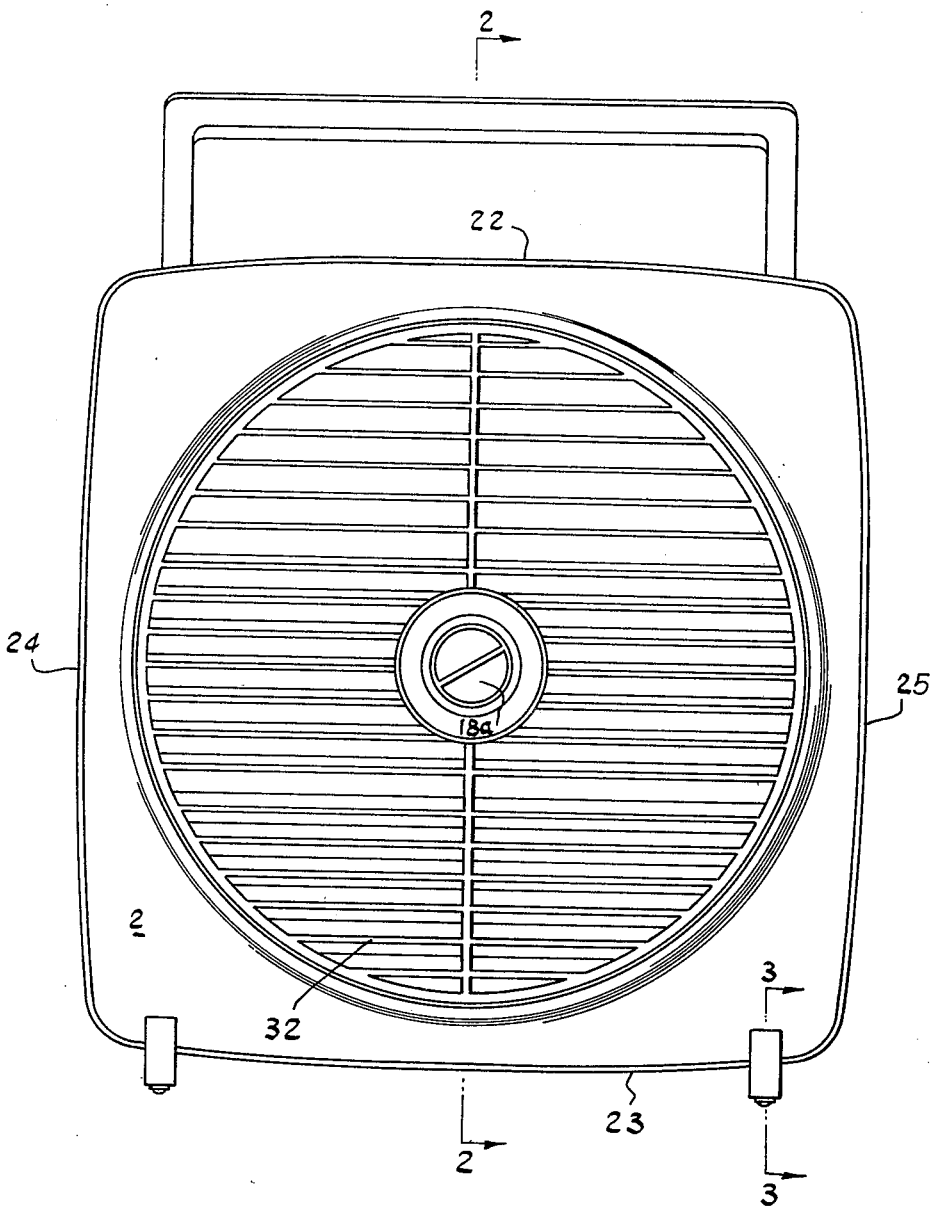
FIG. 1 is a front view of a fan constructed in accordance with the invention.
Figure 2:
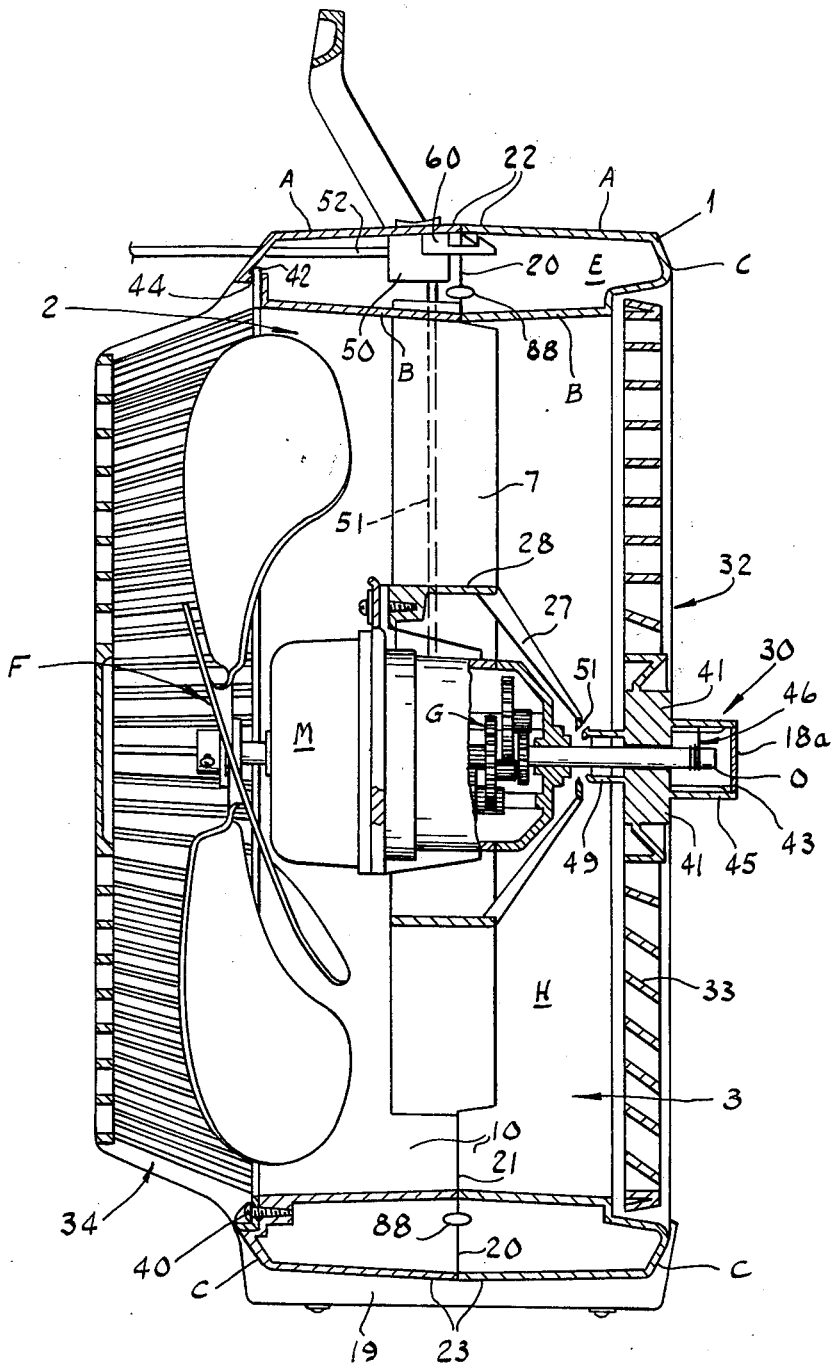
FIG. 2 is a section on the line 2—2 in FIG. 1.

The fan shown comprises a box structure 1 formed from two generally annular plastics mouldings 2, 3. Each of these mouldings has an endless wall of generally U-shaped transverse section made up of generally concentric and generally coaxially extending inner and outer wall portions A, B respectively extending from inner and outer marginal edges respectively of an annular interconnecting wall portion C. The mouldings 2, 3 are assembled together with the free edges of the wall portions A aligned and touching at an interface 20 and with the free edges of the wall portions B aligned and touching at an interface 21 so that the structure 1 is generally torroidal. The wall portions A of each moulding join to form an outer peripheral wall of the structure and the inner wall portions B join to form a generally concentric inner wall. The inner wall, designated by reference numeral 10 in the drawings, is of circular transverse cross section and defines a duct H extending from front to rear of the structure 1, whilst the outer peripheral wall is of generally square cross-section transverse to the axis of the structure 1, being defined by top and bottom wall portions 22, 23 and opposed side wall portions 24, 25.

The walls C define respective front and rear annular wall portions of the structure 1. The wall portions 22, 23, 24, 25 and C, together with wall 10 enclose an interior ring shaped space E within structure 1.

The mouldings 2, 3 are held together by two interior connectors 60 of which only one is visible in the drawings, and by two external resilient clips 19.

Figure 4:
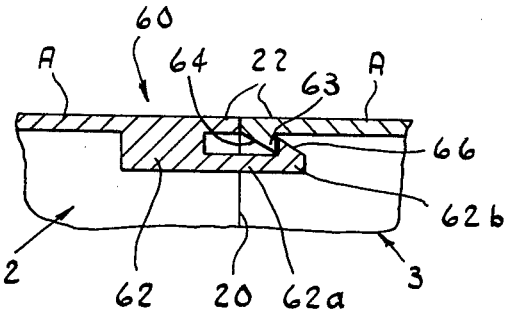
FIG. 4 is a part sectional view of the upper portion of the fan of FIG. 1 showing the method of interconnection thereat of two mouldings of the fan.

Each connector 60 is of the form best shown in FIG. 4 comprising two cooperating elements 62, 63. One element 62 of each connector 60 is fitted to the wall portion A of moulding 2, on the inner surface thereof and at the top of the structure 1. Element 62 is mounted adjacent the interface 20 between the two mouldings 2, 3 and has a tongue portion **62*a* which extends over this interface. Tongue portion 62*a* terminates in an upwardly hooked portion 62*b*. Element 63 of the connector 60 is in the form of an enlarged beading projecting downwardly from the wall portion A of moulding 3 and this cooperates with the hooked portion 62*b*, the hooked portion being engaged over part 63 so that disassembly of the mouldings 2, 3 by pulling these away from the interface 20 is firmly resisted by the cooperating elements 62, 63. Element 63 has an inclined surface 64 and portion 62*b* of element 62 also has an inclined surface 66, these surfaces being so arranged as to cooperate, by camming action therebetween when the two mouldings 2, 3 are brought together at the interface 20 to deflect tongue portion 62*a* slightly to enable the hook portion 62*b* to pass over the element 63 to locate it as shown in FIG. 4. However, for reasons described later, it is preferred that tongue 62*a* be relatively rigid, preferably to the extent where it is rendered difficult to assemble the connection 60 by simple movement of the mouldings 2, 3 towards each other, but requires some "hingeing" action by which the top facing edges of the mouldings are first brought together with the bottoms thereof spaced, to hook the two elements 62, 63** together whereupon the bottoms are swung together.

Figure 3:
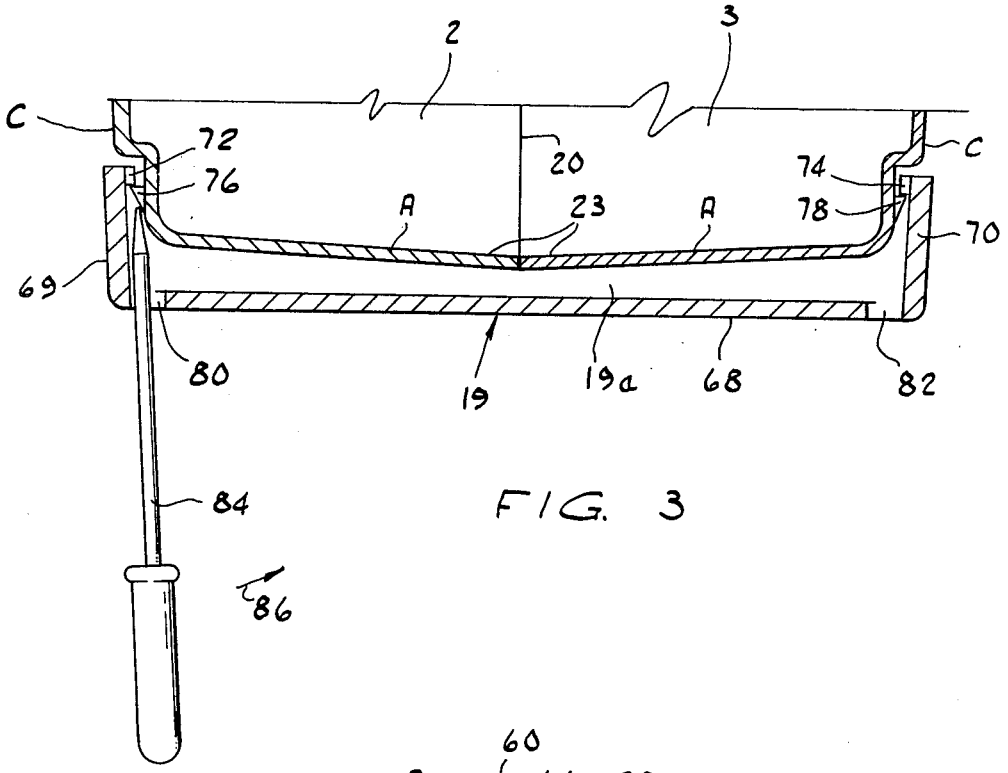
FIG. 3 is an enlarged fragmentary section on the line 3—3 in FIG. 1.

Each clip 19 is of the form best shown in FIG. 3. In addition to serving the purpose of holding the lower parts of the mouldings 2, 3 together the clips also present lower flat surfaces 68 upon which the fan may rest so that the clips form feet for the fan. The clips are formed as plastics mouldings of U-shaped cross section and have an elongate forward to rearwardly extending portion **19*a* with its underside defining surface 68 and its upper side being contoured to fit under the lower wall portion 23 of the structure 1. At each end, separate upwardly extending end portions 69, 70 are formed integrally with portion 19*a*. These have, at upper ends thereof, inwardly directed hook portions 72, 74. Ramps 76, 78 are provided on the forward and rearward portions C of the structure 1. Clips 19 are relatively rigid, but do possess some resilience and the spacing between hook portions 72, 74 is arranged such that each clip can be assembled by engaging hook portions 72, 74 on respective sloping surfaces of the ramps 76, 78 and then pressing the clip towards wall portion 23 whereupon the end portions 69, 70 are deformed by camming action against the ramps 76, 78 to permit them to pass over the ramps and securely enter hook portions 72, 74 over upper ends of the ramps as shown in FIG. 3. It has been found possible to manufacture the clips 19 to be of such strength that it is virtually impossible to remove these by hand. However slots 80, 82 are provided in the undersides of the clips towards the opposite ends of these and, as shown, a screw driver 84 may be inserted into one of these so that the tip of the screw driver extends inside the clip and adjacent the free end of an end portion 69 or 70 whereupon, by moving the handle of the screw driver in the direction indicated by arrow 86, the end portion 69 or 70 can be levered outwardly to permit the corresponding hook portion 72 or 74 to be passed back again over the ramps 76 or 78 to clear the clip from the structure 1** and permit disassembly of the structure.

In order to facilitate alignment of the two mouldings 2, 3 a plurality of tabs 88 are provided on the inner surface of the wall portion A of moulding 2, these projecting across interface 20 to engage the inner surface of the wall portion A of moulding 3.

A fan motor M is supported coaxially within duct H, being secured to a casing 28 supported by generally radial air straightening vanes 7 which extend inwardly from the wall portion B of moulding 2. These vanes are integrally moulded with moulding 2. Motor M has a rearwardly extending axial output shaft to which shaft a fan assembly F for the motor is attached, this fan assembly having a plurality of fan blades constructed in conventional fashion. Motor M has a reduction gear G at its forward end and a forwardly extending axial output shaft O. Shaft O carries a clutch mechanism 30 which interconnects the shaft with a grille 32 at the forward end of duct H. The shaft O turns grille 32 at a relatively low speed when motor M is operated, so that variously aligned vanes 33 on the grille will deflect air passed from the rear end of the duct H to the forward end of the duct in a gyratory air flow pattern as described in Australian patent specification No. 459,701.

The fan assembly F is mounted at the rear end of duct H, this rear end being enclosed by a shallow dished grille 34 secured to the rear wall portion C of moulding 2 by means of two outwardly extending tabs 42 on the periphery of the grille and which engage slots 44 in wall portion C of moulding 2 and by means of a screw 40 which extends through an opening in the grille 34 and into a blind bore on the wall portion C of moulding 2. Alternatively the grille may be provided with three or four outwardly extending tabs located at equally spaced positions on the periphery of the grille. The tabs engage slots in the wall portion C of moulding 2 by resilient deformation of the grille.

The front grille 32 is supported for rotation on shaft O by a central hub 41 through which the shaft extends. Hub 41 has a forwardly projecting peripheral skirt 45 of annular cross-section, this extending in spaced concentric relationship around the forward end of shaft O. A helical spring 46 is carried on shaft O, the convolutions of this being frictionally engaged with the peripheral surface of the shaft. Spring 46 has an outwardly extending arm at one end which can engage any of a number of axial ribs 43 on the inner surface of skirt 45, for transmission of rotary motion from the shaft to the grille, and/or for governing the speed of rotation of a grille driven by the flow of air therethrough. If grille 32 should be externally constrained from rotation, the driving connection between the shaft O and grille is interrupted by partial unwinding of spring 46 whereupon the shaft continues to rotate without rotating the spring. If a user should attempt to manually turn grille 32 faster than the drive from shaft O, driving connection is again interrupted, in this case by slippage of the free end of spring 46 over ribs 43 in succession. By pressing hub 41 inwardly, grille 32 can be locked to prevent it rotating. In this respect spring 46 is axially located on shaft O by engagement of one convolution thereof in a circumferential groove (not shown) on the shaft. This spring therefore limits forward movement of the grille by engagement of the hub 41 with the rear convolution of the spring. Rearward movement of the grille is limited to a position at which the rim of the grille engages an annular part of the wall portion C of moulding 2 immediately behind the rim. However, the allowed movement is sufficient that, by rearward movement of the hub, frictional engagement of three resilient rearwardly projecting locking tongues 49 on the hub with the inner surface of a locking ring 51 occurs. Ring 51 is concentric with shaft O, being carried by struts 27 extending rearwardly from motor casing 28. Movement to enter the tongues into ring 51 is effected by slight inward bowing of the centre of the grille, against the natural resilience of the grille, so that the rim of the grille is then resiliently biassed against the wall portion C of moulding 2. The frictional engagement between the rim of the grille and the adjacent wall portion of moulding 3, and that between ring 51 and tongues 49 is sufficient to lock the grille in place, drive from shaft O being decoupled by partial unwinding of spring 46 as described. The grille is conditioned for rotation by pulling forward of the hub 41 to disengage the tongues 49 from ring 51.

The hub is provided with flush-fitting hub-cap 18*a* provided with three or four outwardly extending lugs which engage corresponding lips on the periphery of the hub interior by resilient deformation of the cap. The hub-cap can thus only be removed by prising the cap off with the use of a sharp screw-driver or purpose designed tool.

It will be appreciated that a person viewing the exterior of structure 1 without knowledge of the mode of its assembly would find it difficult to appreciate how the two moulding parts 2, 3 had been assembled. Particularly, the clamps 19 appear merely to serve the function of feet for the fan and there are no screws visible which suggest that the two parts had been screwed together.

Motor M is controlled by a switch 50, which may for example incorporate a speed regulating device, this being mounted within space E such as on the wall portion A of moulding 2 as shown. A two-wire flex 52 for connection of the fan to a source of electricity extends through moulding 2 and connects to the switch, whilst further wires 51 interconnect the switch and motor. The switch is contained entirely within space E of the structure 1 and because, as described, access to this space can only be achieved by disassembling the mouldings 2 and 3 in a way which would not be immediately apparent to observers, the resultant arrangement is most desirable insofar as electrical safety is concerned.

The described arrangement has been advanced merely by way of explanation and many modifications may be made thereto without departing from the spirit and scope of the invention which includes every novel feature and combination of novel features herein disclosed.

I claim:

1. A box fan comprising a box-like structure containing an electric motor and a fan blade assembly operable by the motor, which structure consists of a front section and a rear section forming a box having front and rear openings which are interconnected to form a duct through said box, the fan blade assembly being positioned for causing air flow through the duct when the motor is operating, wherein the two sections are held securely together by a locking means including external resiliently operable disguised clamps which are disposed transversely of the interface between said sections, said locking means further including an interlocking means, elements of which include the combination of an interfacial edge on a first of the sections; a tongue adjacent the edge and interiorly of said first section, said tongue terminating in a hooked portion and extending beyond the adjacent interfacial edge; an interfacial edge on the second of the sections opposing that of the first; and a hooked portion adjacent the interfacial edge of the second section and interiorly of said second section and located in alignment with said tongue and cooperating to engagingly receive the tongue hooked portion when the two sections are assembled by first being pivoted about an axis formed by joining the interfacial edges adjacent the cooperating hooked portions to provide leverage for engaging said hooked portions upon swinging the sections together to complete the assembly of the box, said clamps being positioned at a side of the box opposite that of said interlocking means to retain the engagement of the cooperating elements.

2. A box fan according to claim 1, wherein the electric control equipment for the fan is housed in said box.

3. A box fan according to claim 1, wherein the elements of the inter-locking means are integrally moulded with said sections.

4. A box fan according to claim 1, wherein electrical control equipment is located in the interior of said box and connected to the motor by means of insulated conductors extending through the wall of said duct into the interior of said box.

5. A box fan according to claim 1, wherein each said clamp is resilient and has a base portion which underlies the said box and upstanding end portions with inwardly projecting hook portions at free ends of said end portions, said sections having ramp elements disposed to engage the hook members, and, by camming action, outwardly deform these against the resilience of the clip when the clamp is pressed upwards at juxtaposed structure sections to allow the hook portions to pass over outwardly projecting ends of the ramp elements whereupon the end portions resiliently return inwardly to locate said hook portions over the ramp elements whereby the clamp holds the sections together.

6. A box fan according to claim 5, wherein the clamps are provided with openings in said base portions adjacent the upstanding end portions to enable each end portion to be levered outwardly, by insertion of a rod extending parallel to the end portion through the opening adjacent thereto to clear the corresponding hook portion from engagement over its cooperating ramp element thereby to permit removal of the clamp and disassembly of said structure.

7. A box fan comprising a boxlike structure containing an electric motor and a fan blade assembly operable by the motor; which structure consists of a front section and a rear section forming a box having front and rear openings which are interconnected to form a duct through said box, the fan blade assembly being positioned for causing air flow through the duct when the motor is operating, and which structure has a rear grille covering said rear opening and a front grille having air directing louvres disposed at different angles to the direction of air flow; wherein (a) the two sections are held securely together by a locking means including an internal interlocking means comprising cooperating interlocking elements interiorly adjacent with respect to and extending across the interface between sections on one side of said box and adapted to engage by a hinging action utilizing the adjacent interface as an axis to then swing the sections together and engage the interlocking elements, and external resiliently operable disguised clamps which are disposed transversely of the interface between said sections on the side of said box opposite said interlocking means, (b) the dished rear grille has a plurality of outwardly extending tabs located on the periphery of the grille which tabs are adapted to engage corresponding slots in the rear of the duct by resilient deformation of said grille, (c) the front grille is connected by means of a slipping clutch mechanism to an output shaft which is connected to the motor through reduction gearing such that when the fan is in use the front grille slowly rotates.

8. A box fan according to claim 7, wherein each of said external resiliently operable disguised clamps is resilient and has a base portion which underlies the said box and upstanding end portions with inwardly projecting hook portions at free ends of said end portion, said sections having ramp elements disposed to engage the hook members and, by camming action, outwardly deform these, against the resilience of the clip, when the clamp is pressed towards the juxtaposed structure sections to allow the hook portions to pass over outwardly projecting ends of the elements whereupon the end portions resiliently return inwardly to locate said hook portions over the elements whereby the clamp holds the sections together.

9. A box fan according to claim 7, wherein the front grille is provided with a central hub and a hub-cap for enclosing said slipping clutch and said output shaft, which hub-cap is provided with a plurality of outwardly extending lugs adapted to engage corresponding lips on the periphery of the hub interior in order to secure the cap flush with the periphery of the hub.

* * * * *